US009680269B2

(12) United States Patent
Lisbona

(10) Patent No.: US 9,680,269 B2
(45) Date of Patent: Jun. 13, 2017

(54) ELECTRICAL CONTACTOR WITH HEADER CONNECTORS

(71) Applicant: Lennox Industries Inc., Richardson, TX (US)

(72) Inventor: Randall Lee Lisbona, Coppell, TX (US)

(73) Assignee: Lennox Industries Inc., Richardson, TX (US)

( * ) Notice: Subject to any disclaimer, the term of this patent is extended or adjusted under 35 U.S.C. 154(b) by 709 days.

(21) Appl. No.: 13/962,376

(22) Filed: Aug. 8, 2013

(65) Prior Publication Data

US 2015/0044910 A1 Feb. 12, 2015

(51) Int. Cl.

| | |
|---|---|
| ***H01R 13/68*** | (2011.01) |
| ***H01R 25/00*** | (2006.01) |
| ***H01H 71/12*** | (2006.01) |
| *H01H 71/58* | (2006.01) |
| *H01H 71/04* | (2006.01) |

(52) U.S. Cl.

CPC ..... *H01R 25/006* (2013.01); *H01H 71/123* (2013.01); *H01H 71/58* (2013.01); *H01H 2071/046* (2013.01)

(58) Field of Classification Search

CPC ..... H01R 25/006
USPC ..... 340/870.01, 870.02, 870.03
See application file for complete search history.

(56) References Cited

U.S. PATENT DOCUMENTS 5,057,026 A * 10/1991 Sawai ..... H05K 7/026 439/43
5,131,455 A * 7/1992 Tsuchiyama ..... F24F 1/027 165/240
5,249,981 A * 10/1993 Abell ..... H01R 13/6485 439/540.1
5,539,168 A * 7/1996 Linzenich ..... H02B 1/056 200/303
6,217,370 B1 * 4/2001 Scheel ..... H01R 13/6335 439/483
6,232,859 B1 * 5/2001 Christensen ..... H01H 71/465 335/132
6,982,650 B1 * 1/2006 Asplund ..... G01R 21/133 324/117 R
8,279,586 B2 * 10/2012 Fidacaro ..... A61B 5/0002 340/870.01

(Continued)

*Primary Examiner* — Amine Benlagsir
(74) *Attorney, Agent, or Firm* — Hubbard Johnston PLLC

(57) ABSTRACT

A disclosed electrical contactor may include a line-side electrical terminal adapted for connection to an electrical conductor carrying an electrical voltage, multiple load-side connectors each having a housing and multiple electrical terminals arranged within a cavity of the housing, a switching element, and a control unit. Each of the load-side connectors is adapted to receive a plug connector. The switching element electrically connects the line-side electrical terminal to electrical terminal(s) of at least one of the load-side connectors when enabled. The control unit enables the switching element in response to a control signal. Each of the load devices may have a plug connector, and each of the load-side connectors may be mechanically coded to receive the plug connector of a corresponding load device. An electrical configuration of electrical terminals of a line-side connector may allow a crankcase heater, or a crankcase heater with thermostat, to receive electrical power.

9 Claims, 4 Drawing Sheets

(56) References Cited

U.S. PATENT DOCUMENTS

| | | | | |
|---|---|---|---|---|
| 2007/0126570 | A1* | 6/2007 | Kathan | H01R 13/6683 340/533 |
| 2010/0271234 | A1* | 10/2010 | Moulard | G01D 4/02 340/870.02 |
| 2012/0170174 | A1* | 7/2012 | Lisbona | H01R 27/00 361/631 |
| 2012/0253520 | A1* | 10/2012 | Sartain | F24F 11/0012 700/276 |
| 2013/0344746 | A1* | 12/2013 | Andersson | H01R 31/005 439/638 |

* cited by examiner

ELECTRICAL CONTACTOR WITH HEADER CONNECTORS

BACKGROUND

Field of the Invention

The present invention relates to electrical switching devices and, more particularly, to an electrical contactor utilized as a central wiring point.

Description of Related Art

An electrical contactor is an electrically controlled switch used for selectively providing electrical power to one or more load devices. Contactors are used to control electric motors, lighting, heating, capacitor banks, thermal evaporators, and other electrical loads. A typical electrical contactor has control terminals for connecting to a control circuit, line terminals for connecting to conductors providing electrical power (i.e., line conductors), and load terminals for connecting to one or more load devices.

In heating, ventilating, and air conditioning (HVAC) systems, a contactor is commonly used as a wiring junction, and multiple load devices are connected to the load terminals. The load devices must be connected to the load terminals in specific ways for the load devices, and the HVAC system as a whole, to operate safely and efficiently.

A problem arises with contactors if a wiring error is made when connecting load devices to the load terminals, such as during original assembly, when faulty load devices are replaced, or when new load devices are added, the wiring error may result in injury to a technician performing the work, damage to the contactor or one or more of the load devices, and/or create an unsafe operating condition.

SUMMARY

The problems outlined above are at least in part addressed by a novel electrical contactor that may include a line-side electrical terminal adapted for connection to an electrical conductor carrying an electrical voltage, one or more load-side connectors each having a housing and multiple electrical terminals arranged within a cavity of the housing, a switching element, and a control unit. One or more of the load-side connectors is adapted to receive a plug connector. The switching element electrically connects the line-side electrical terminal to one or more electrical terminal(s) of at least one of the load-side connectors when enabled. The control unit receives a control signal and enables the switching element in response to the control signal. Each of the load devices may be connected to a corresponding plug connector, and each of the load-side connectors may be mechanically coded to receive the plug connector of a corresponding load device. In one embodiment, an electrical configuration of electrical terminals of a line-side connector may allow a load, such as a crankcase heater, or a load with a switch, such as a thermostat, to receive electrical power via the line-side connector.

BRIEF DESCRIPTION OF THE DRAWINGS

A better understanding of the various disclosed embodiments can be obtained when the detailed description is considered in conjunction with the following drawings, in which.

Figure 1:
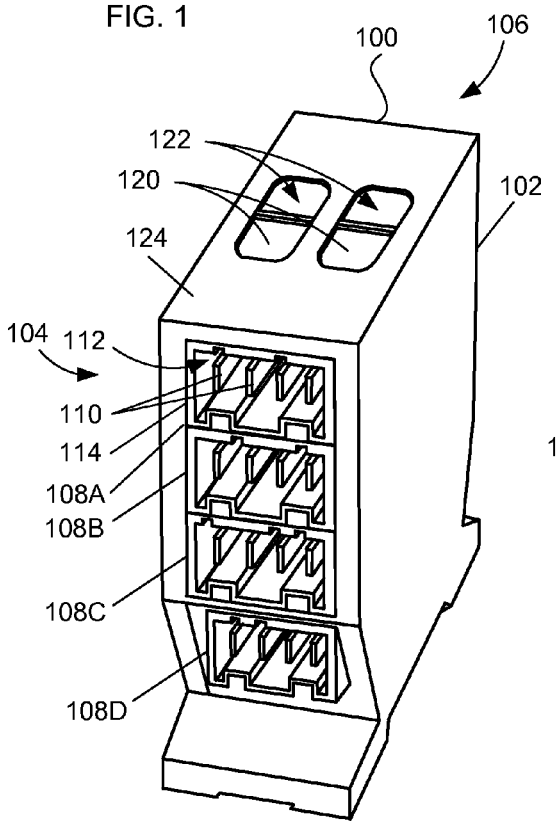
FIG. 1 is a perspective view of a line side of one embodiment of an electrical contactor.

While the invention is susceptible to various modifications and alternative forms, specific embodiments are shown by way of example in the drawings and will be described in detail. It should be understood, however, that the drawings and detailed description are not intended to limit the invention to the particular form disclosed, but on the contrary, the intention is to cover all modifications, equivalents and alternatives falling within the spirit and scope of the invention as defined by the appended claims.

DETAILED DESCRIPTION

Turning now to the figures, FIG. 1 is a perspective view of a line side 104 of one embodiment of an electrical contactor 100. As described in detail below, the electrical contactor 100 may include multiple header connectors each configured to accept a mating plug connector of a specific equipment item (e.g., load device), thereby eliminating wiring errors that may injure personnel, damage equipment, or create unsafe operating conditions.

In the embodiment of FIG. 1, the contactor 100 may include a housing 102 having the line side 104 and an opposed load side 106. Four stacked tab header connectors 108A-108D are positioned in the line side 104, and another four stacked tab header connectors 108E-108H are positioned in the load side 106 (see FIG. 2). Each of the tab header connectors 108A-108H is a shrouded header connector with multiple, spaced apart tab terminals arranged in a cavity such that the tab terminals are recessed within the cavity. As shown in FIG. 1, the tab header connector 108A has four spaced apart tab terminals 110 arranged in a cavity 112 such that the tab terminals 110 are recessed within the cavity 112 with respect to an outer face 114 of the tab header connector 108A. The tab header connectors 108A-108H are described in more detail below with respect to FIG. 3.

In the embodiment of FIG. 1, the line-side tab header connector 108D is a control connector, and has two tab terminals adapted to receive a control signal (e.g., an electrical voltage). The contactor 100 is enabled when the control signal is present (or is active), and is not enabled when the control signal is absent (or is inactive).

The line-side tab header connector 108A is a line connector, and the line-side tab header connectors 108B and 108C are line-side device connectors. The line-side tab header connector 108A has two tab terminals each adapted for connection to an electrical conductor carrying an electrical voltage (i.e., a line conductor). Tab terminals of the line-side tab header connectors 108B and 108C may be connected to corresponding tab terminals of the line-side tab header connector 108A in a serial or daisy-chain fashion by relatively short electrical conductors called jumpers within the contactor 100 (see FIG. 4).

Line-side devices that are intended to continuously receive electrical power may be powered via the line-side tab header connectors 108B and/or 108C. By virtue of the internal jumpers, when each of the two terminals of the tab header connector 108A is connected to a line conductor, corresponding terminals of each of the line-side tab header connectors 108B-108C are also connected to the line conductors. As a result, one or more line-side devices intended to continuously receive electrical power may be powered via the line conductors and the line-side tab header connectors 108A-108C. For example, a connector plug of a line-side device may be plugged into the tab header connector 108B or 108C, allowing the line-side device to continuously receive electrical power via the line conductors, the tab header connector 108A, and the tab header connector 108B or 108C.

In some embodiments, each of several different line-side devices may be connected to a unique and corresponding plug connector, and each of the line-side tab header connectors 108B and 108C is adapted to receive a different one of the plug connectors. More specifically, a housing of each of the plug connectors is mechanically coded to a housing of a corresponding one of the line-side tab header connectors 108B and 108C such that each of the plug connectors can only be inserted into the corresponding one of the line-side tab header connectors 108B and 108C. For example, a plug connector may have a housing mechanically coded for the line-side tab header connector 108B such that the plug connector cannot physically be inserted into the line-side tab header connector 108C, and vice versa. Moreover, a plug connector may have a housing mechanically coded for the line-side tab header connector 108B such that the plug connector cannot physically be inserted into any one of the other tab header connectors 108A and 108C-108H.

Figure 2:
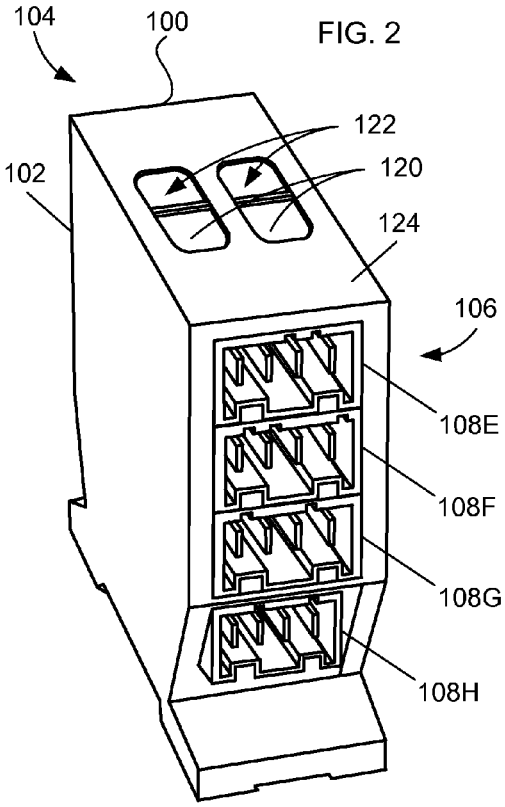
FIG. 2 is a perspective view of a load side of the contactor of FIG. 1.

FIG. 2 is a perspective view of the load side 106 of the housing 102 of the contactor 100 showing the four stacked tab header connectors 108E-108H positioned in the load side 106. In the embodiment of FIG. 2, two tab terminals of the load-side tab header connector 108E are electrically connected to corresponding terminals of the line-side tab header connector 108A only when the contactor 100 is enabled. When the corresponding terminals of the line-side tab header connector 108A are connected to line conductors, the two terminals of the load-side tab header connector 108E are electrically connected to the line conductors only when the contactor 100 is enabled.

One or more load-side devices that are intended to receive electrical power only when the contactor 100 is enabled may be powered via the load-side tab header connectors 108E-108H. Tab terminals of the line-side tab header connectors 108F-108H may be connected to corresponding tab terminals of the load-side tab header connector 108E in a serial or daisy-chain fashion by jumper conductors within the contactor 100 (see FIG. 4). By virtue of the internal jumpers, when each of the two terminals of the load-side tab header connector 108E is electrically connected to a line conductor via the switching element, corresponding terminals of the load-side tab header connectors 108F-108H are also connected to the line conductors. As a result, one or more load-side devices that are intended to receive electrical power only when the contactor 100 is enabled may be powered via the load-side tab header connectors 108E-108H. For example, a connector plug of a load-side device may be plugged into a corresponding one of the tab header connectors 108E-108H, allowing the load-side device to receive electrical power only when the contactor 100 is enabled via the line conductors, the tab header connector 108A, and the one of the load-side tab header connectors 108E-108H into which the connector plug is inserted In some embodiments, each of several different load devices may be connected to a unique and corresponding plug connector, and each of the load-side tab header connectors 108E-108H is adapted to receive a different one of the plug connectors. More specifically, a housing of each of the plug connectors is mechanically coded to a housing of a corresponding one of the load-side tab header connectors 108E-108H such that each of the plug connectors can only be inserted into the corresponding one of the load-side tab header connectors 108E-108H. For example, a plug connector of a load-side device may have a housing mechanically coded for the load-side tab header connector 108E such that the plug connector cannot physically be inserted into any one of the other load-side tab header connectors 108F-108H, or into any one of the line-side tab header connectors 108A-108D.

In the embodiment of FIGS. 1 and 2, the contactor 100 includes an electromechanical switching mechanism described in more detail below. The switching mechanism may include two pairs of electrical contacts (contacts 408 and 410 in FIG. 4) connected to a mechanical slide. Two portions of an upper surface of the slide, labeled 120 in FIGS. 1 and 2, are visible in two openings 122 in an upper surface 124 of the housing 102. When a coil of the contactor 100 is energized, the slide is pulled downward into the housing 102, the two portions 120 of the upper surface of the slide recede into the housing 102 and are no longer adjacent the two openings 122 in an upper surface 124 of the housing 102, and the two pairs of contacts are closed. The contactor 100 may also be momentarily enabled manually by depressing one or both of the two portions 120 of the upper surface of the slide, causing the two pairs of contacts to close. The two portions 120 of the upper surface of the slide thus function as an indicator indicating whether the two pairs of contacts are closed (i.e., whether the contactor 100 is enabled). That is, when the two portions 120 of the upper surface of the slide are adjacent the two openings 122 in the upper surface 124 of the housing 102 as shown in FIGS. 1 and 2, the two pairs of contacts are open and the contactor 100 is not enabled. When the two portions 120 of the upper surface of the slide have receded into the housing 102 and are not adjacent the two openings 122, the two pairs of contacts are closed and the contactor 100 is enabled.

Figure 3:
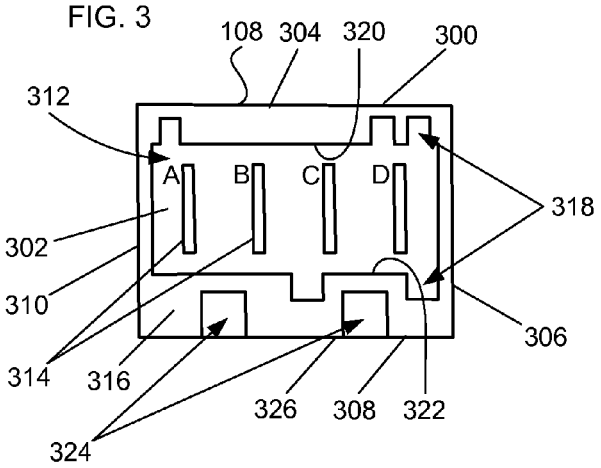
FIG. 3 is a front view of a representative one of the multiple tab header connectors of the contactor of FIG. 1.

FIG. 3 is a front view of a representative one of the tab header connectors 108A-108H of the contactor 100, labeled 108 in FIG. 3. The representative tab header connector 108 may include an insulative housing 300 having a base 302 and four walls extending from the base 302; an upper wall 304, a lower wall 308, and two side walls 306 and 310. The base 302, an upper wall 304, two side walls 306 and 310, and a lower wall 308 form a cavity 312 (e.g., the cavity 112 of the tab header connector 108A shown in FIG. 1). There are four spaced apart slots in the base 302, and four tab terminals 314 (e.g., the tab terminals 110 of the tab header connector 108A shown in FIG. 1) extend through the slots in the base 302. In FIG. 3, the four tab terminals 314 are labeled "A," "B," "C," and "D" from left to right. The tab terminals 314 may be spaced apart 5 mm or another distance sufficient to avoid electrical arching between the terminals when in use. Additionally, the four tab terminals 314 are recessed within the cavity 312 with respect to an outer face 316 of the representative tab header connector 108 (e.g., the outer face 114 of the tab header connector 108A shown in FIG. 1). Accordingly, the representative tab header connector 108 is a shrouded header connector with multiple, spaced apart tab terminals 314 arranged in the cavity 312 such that the tab terminals 314 are recessed within the cavity 312.

As shown in FIG. 3, multiple keying and/or polarization slots 318 are formed in an inner surface 320 of the upper wall 304, and in an inner surface 322 of the lower wall 308. In some embodiments, each of the tab header connectors 108A-108H has one or more keying slots configured differently such that only a corresponding plug connector will fit in the tab header connector. For example, each of the tab header connectors 108A-108H shown in FIGS. 1 and 2 may have keying slots configured such that a plug connector configured to fit in a corresponding one of the tab header connectors 108A-108H will not fit in any one of the other tab header connectors 108A-108H.

In the embodiment of FIG. 3, two latch windows 324 are formed in an outer surface 326 of the lower wall 308. Each of the latch windows 324 is configured to receive a male latch member of the corresponding plug connector. When the corresponding plug connector is inserted into the representative tab header connectors 108, the male latch member engages the insulative housing 300 and holds the plug connector in place.

In the embodiment of FIGS. 1-3, each of the tab header connectors 108A-108H conforms to the Raster Anschluss Steck Tecknik (RAST) standard for tab header connectors. In other embodiments some or all of the tab header connectors 108A-108H may or may not conform to a header connector standard. For example, in other embodiments some or all of the tab header connectors 108A-108H may include screw terminals or box lug terminals, or terminals may be spaced apart a distance other than specified in a header connector standard.

In the embodiment of FIG. 3, the terminals 314 include flat, rectangular mating "tab" portions made of an electrically conductive material (e.g., a metal), and are male terminals adapted to engage corresponding female terminals (e.g., of a plug connector). Other configurations of the terminals 314 are also possible. For example, in other embodiments the terminals 314 may be female terminals adapted to engage corresponding male tab terminals (e.g., of a plug connector). Other shapes of the mating portions of the terminals 314 are also possible. For example, in other embodiments the terminals 314 may be cylindrical "bullet" connectors adapted to engage corresponding female terminals.

Figure 4:
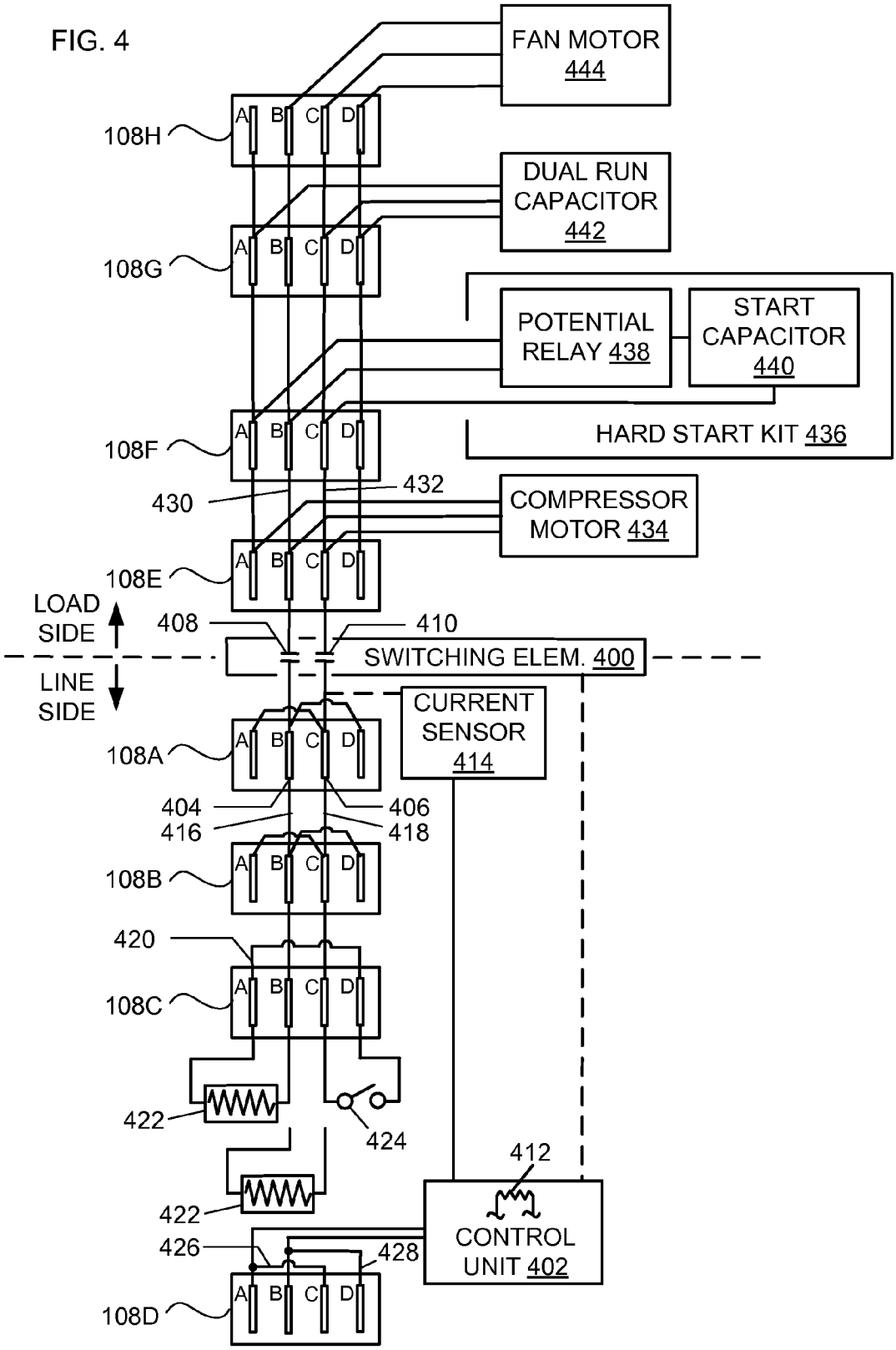
FIG. 4 is a wiring diagram of the contactor of FIG. 1.

FIG. 4 is a wiring diagram of the contactor 100 of FIG. 1. As indicated in FIG. 4, the contactor 100 may include a switching element 400 and a control unit 402. The control unit 402 is coupled to the line-side tab header connector 108D and to the switching element 400. The control unit 402 receives the control signal via the tab header connector 108D, and controls the switching element 400 in response to the control signal.

In FIG. 4 the two tab terminals of the tab header connector 108A adapted for connection to line conductors are labeled "404" and "406." The line conductors may be, for example, alternating current line conductors carrying voltages that are 180 degrees out of phase.

In the embodiment of FIG. 4, an internal jumper 416 electrically connects the tab terminal "B" of the tab header connector 108A to the tab terminal "B" of the tab header connector 108B. An internal jumper similar to the jumper 416 may connect the tab terminal "B" of the tab header connector 108B to the tab terminal "B" of the tab header connector 108C. Accordingly, internal jumpers may connect corresponding tab terminals "B" of the line-side tab header connectors 108A-108C in a serial or daisy-chain fashion, and when the tab terminal 404 of the line-side tab header connectors 108A is connected to a line conductor, the tab terminals "B" of the line-side tab header connectors 108A-108C are all electrically connected to the line conductor.

In the embodiment of FIG. 4, an internal jumper 418 electrically connects the tab terminal "C" of the tab header connector 108A to the tab terminal "C" of the tab header connector 108B. An internal jumper similar to the jumper 418 may connect the tab terminal "C" of the tab header connector 108B to the tab terminal "C" of the tab header connector 108C. Accordingly, internal jumpers may connect corresponding tab terminals "C" of the line-side tab header connectors 108A-108C in a serial or daisy-chain fashion, and when the tab terminal 406 of the line-side tab header connectors 108A is connected to a line conductor, the tab terminals "C" of the line-side tab header connectors 108A-108C are all electrically connected to the line conductor.

In the embodiment of FIG. 4, an internal jumper 420 electrically connects the tab terminal "A" of the tab header connector 108C to the tab terminal "D" of the tab header connector 108C. This electrical configuration of the tab header connector 108C allows connection of a load such as a crankcase heater 422 alone, or in series with an activating switch or thermostat 424, to the tab header connector 108C. When connection of the crankcase heater 422 in series with the activating thermostat 424 is desired, the crankcase heater 422 may be connected between the terminals "A" and "B" of the tab header connector 108C, and the thermostat 424 may be connected between the terminals "C" and "D" of the tab header connector 108C, as indicated in FIG. 4. In this situation, the crankcase heater 422 will be powered only when the switch or thermostat 424 is closed. When the thermostat 424 closes, electrical current will flow through an electrical circuit formed between the terminals "B" and "C" of the tab header connector 108C that may include the internal jumper 420.

When connection of the crankcase heater 422 alone is desired, the crankcase heater 422 may be connected between the terminals "B" and "C" of the tab header connector 108C as indicated in FIG. 4. In this situation, the crankcase heater 422 will expectedly be continuously powered via the line conductors electrically connected to the terminals "B" and "C" of the tab header connector 108C.

In the embodiment of FIG. 4, the control unit 402 may include a coil 412, and the switching element 400 may include two sets of contacts 408 and 410 operated in unison. When the control unit 402 receives the control signal (or when the control signal is active), the control unit 402 may apply electrical voltage to the coil 412, causing electrical current to flow through the coil 412, and creating a magnetic field around the coil 412. This magnetic field is coupled to the switching element 400, and causes the contacts 408 and 410 to close. When the magnetic field is not present, the contacts 408 and 410 are open. In other embodiments, the switching element 400 and/or the control unit 402 may include semiconductor devices, and the switching mechanism including the switching element 400 and/or the control unit 402 may be termed a solid state mechanism.

In some embodiments, the switching element 400 may include a single set of contacts, either the contacts 408 or the contacts 410. For example, in an embodiment with only the contacts 408, a jumper may connect the tab terminal 406 (tab terminal "C" of the tab header connector 108A) to the tab terminal "C" of the tab header connector 108E. In an embodiment with only the contacts 410, a jumper may connect the tab terminal 404 (tab terminal "B" of the tab header connector 108A) to the tab terminal "B" of the tab header connector 108E.

In the embodiment of FIG. 4, the line-side tab header connector 108D is the control connector, and has two tab terminals "A" and "B" adapted to receive a control signal (e.g., an electrical voltage or current). An internal jumper 426 may connect the tab terminal "A" of the tab header connector 108D to a tab terminal "C," and an internal jumper 428 may connect the tab terminal "B" of the tab header connector 108D to a tab terminal "D." This allows the control signal to be passed through the tab header connector 108D and on to another electrical switching device (e.g., another contactor). This action is often referred to as "twinning."

In the embodiment of FIG. 4, the switching element 400 is coupled between the line-side tab header connector 108A and the load-side tab header connector 108E. When the contacts 408 are closed, the tab terminal 404 is electrically connected to the tab terminal "B" of the tab header connector 108E. An internal jumper 430 electrically connects the tab terminal "B" of the tab header connector 108E to the tab terminal "B" of the tab header connector 108F. Internal jumpers similar to the jumper 430 may connect the tab terminal "B" of the tab header connector 108F to the tab terminal "B" of the tab header connector 108G, and the tab terminal "B" of the tab header connector 108G to the tab terminal "B" of the tab header connector 108H. Accordingly, internal jumpers may connect corresponding tab terminals "B" of the load-side tab header connectors 108E-108H in a serial or daisy-chain fashion, and when the contacts 408 are closed the tab terminal 404 is electrically connected to the tab terminals "B" of the tab header connectors 108E-108H.

When the contacts 410 are closed, the tab terminal 406 may be electrically connected to the tab terminal "C" of the tab header connector 108E. An internal jumper 432 may electrically connect the tab terminal "C" of the tab header connector 108E to the tab terminal "C" of the tab header connector 108F. Internal jumpers similar to the jumper 432 connect the tab terminal "C" of the tab header connector 108F to the tab terminal "C" of the tab header connector 108G, and the tab terminal "C" of the tab header connector 108G to the tab terminal "C" of the tab header connector 108H. Accordingly, internal jumpers may connect corresponding tab terminals "C" of the load-side tab header connectors 108E-108H in a serial or daisy-chain fashion, and when the contacts 410 are closed, the tab terminal 406 may be electrically connected to the tab terminals "C" of the tab header connectors 108E-108H.

In the embodiment of FIG. 4, the contactor 100 also may include an optional current sensor 414. The current sensor 414 may be coupled to a conductor (e.g., a wire) connected between the tab terminal 406 (the tab terminal "C" of the tab header connector 108A) and contacts 410 of the switching element 400, and to the control unit 402. The current sensor 414 senses electrical current in the conductor and provides a signal to the control unit 402 that is indicative of a magnitude of the electrical current in the conductor.

In some embodiments, immediately after sending a signal to the switching element 400 to close the contacts 408 and 410, the control unit 402 monitors the signal from the current sensor 414. If the electrical current in the conductor exceeds a current limit for a period of time that exceeds a time limit, the control unit 402 sends a signal to the switching element 400 to open the contacts 408 and 410. This would expectedly occur, for example, when there is a very low resistance (e.g., a short circuit) in a load device coupled to one of the tab header connectors 108E-108H (i.e., a "fault condition").

The current sensor 414 may include, for example, a Hall effect current transducer for sensing electrical current in the conductor connected between the tab terminal 406 (the tab terminal "C" of the tab header connector 108A) and contacts 410 of the switching element 400. The model FHS 40-P/SP600 Hall effect current transducer made by LEM (Geneva, Switzerland) is believed to be a suitable Hall effect current transducer. The current sensor 414 may be mounted on a printed circuit board (PCB), not shown, secured within the housing 102. The PCB may also be inserted into the housing 102 by sliding the PCB into a slot in one of the walls of the housing 102.

In the embodiment of FIG. 4, several different heating, ventilating, and air conditioning (HVAC) load devices may be connected to the load-side tab header connectors 108E-H. The tab header connector 108E has one or more keying slots (see FIG. 3) configured to accept a mating plug connector of a compressor motor 434. When the plug connector of the compressor motor 434 is inserted in the tab header connector 108E, a "Start" terminal of the compressor motor 434 may be connected to the tab terminal "A" of the tab header connector 108E, a "Common" terminal of the compressor motor 434 is connected to the tab terminal "B", and a "Run" terminal of the compressor motor 434 is connected to the tab terminal "C". The "Common" and "Run" terminals of the compressor motor 434 are connected to the line conductors when the contactor 100 is enabled and the contacts 408 and 410 of the switching element 400 are closed. The plug connector of the compressor motor 434 cannot physically be inserted into one of the other tab header connectors 108A-108D and 108F-108H, preventing wiring mishaps that may damage equipment or pose safety problems.

In the embodiment of FIG. 4, the tab header connector 108F has one or more keying slots (see FIG. 3) configured to accept a mating plug connector of an accessory such as a hard start kit 436. The hard start kit 436 may include a potential relay 438 and a start capacitor 440. When the plug connector of the hard start kit 436 is inserted in the tab header connector 108F, a first terminal of the potential relay 438 may be connected to the tab terminal "A" of the tab header connector 108F, a second terminal of the potential relay 438 is connected to the tab terminal "B," and a first terminal of the start capacitor 440 may be connected to the tab terminal "C". A third terminal of the potential relay 438 may be connected to a second terminal of the start capacitor 440. During operation, the potential relay 438 may connect the start capacitor 440 between the tab terminals "B" and "C" of the tab header connector 108F for a short period of time after the contactor 100 is enabled (i.e., when the compressor motor 434 starts), increasing the starting current and torque of an electric motor of the compressor motor 434. The plug connector of the hard start kit 436 cannot physically be inserted into one of the other tab header connectors 108A-108E and 108G-108H, preventing wiring mishaps.

In the embodiment of FIG. 4, the tab header connector 108G has one or more keying slots (see FIG. 3) configured to accept a mating plug connector of a motor run capacitor or dual run capacitor 442. When the plug connector of the dual run capacitor 442 is inserted in the tab header connector 108G, a "Hermetic" terminal of the dual run capacitor 442 may be connected to the tab terminal "A" of the tab header connector 108G, a "Common" terminal of the dual run capacitor 442 may be connected to the tab terminal "C," and a "Fan" terminal of the dual run capacitor 442 may be connected to the tab terminal "D." Jumpers between the tab terminals of the tab header connectors 108E, 108F, and 108G may allow the "Common" terminal of the dual run capacitor 442 to be connected to one of the line conductors when the switching element 400 is energized and the contacts 410 are closed, and properly interconnect the fan motor 444, the compressor motor 434, and the dual run capacitor 442.

As indicated in FIG. 4, an internal jumper may connect the tab terminal "A" of the tab header connector 108G to the tab terminal "A" of the tab header connector 108F, and a similar jumper may connect the tab terminal "A" of the tab header connector 108F to the tab terminal "A" of the tab header connector 108E. Thus the "Start" terminal of the compressor motor 434 may be connected to the "Hermetic" terminal of the dual run capacitor 442. When the contacts 410 of the switching element 400 are closed, the "Run" terminal of the compressor motor 434 and the "Common" terminal of the dual run capacitor 442 may be connected to one of the line conductors. The plug connector of the dual run capacitor 442 cannot physically be inserted into one of the other tab header connectors 108A-108F and 108H, preventing wiring mishaps.

In the embodiment of FIG. 4, the tab header connector 108H has one or more keying slots (see FIG. 3) configured to accept a mating plug connector of an electrical load such as a fan motor 444. When the plug connector of the fan motor 444 is inserted in the tab header connector 108H, a "Common" terminal of the fan motor 444 may be connected to the tab terminal "B" of the tab header connector 108H, a "Run" terminal of the fan motor 444 may be connected to the tab terminal "C," and a "Start" terminal of the fan motor 444 may be connected to the tab terminal "D". As indicated in FIG. 4, internal jumpers may be connected to the tab terminals "D" of the tab header connectors 108H and 108G, thus the "Start" terminal of the fan motor 444 may be connected to the "FAN" terminal of the dual run capacitor 442. When the contacts 408 and 410 of the switching element 400 are closed, the "Common" and "Run" terminals of the fan motor 444 are connected to the line conductors. The plug connector of the fan motor 444 cannot physically be inserted into one of the other tab header connectors 108A-108G, preventing wiring mishaps.

It is noted that the jumpers between the tab terminals of the tab header connectors 108A-108C and 108E-108H, and the arrangement of the tab terminals in the tab header connectors, allow wire conductors that extend from the contactor 100 to a load device, such as the compressor motor 434, the fan motor 444, and the crankcase heater 422, to terminate in a common plug connector. As the wire conductors are kept in close proximity to one another, they can therefore be bundled together in a wiring harness.

In the embodiment of FIG. 4, the tab terminals "A" of the load-side tab header connectors 108E-108G are connected to one another via jumpers, and are not directly connected to the tab terminals "B" and "C" of the tab header connectors 108E-108H that receive switched electrical power when the switching element 400 is enabled. Similarly, the tab terminals "D" of the tab header connectors 108G-108H are connected to one another via jumpers, and are not directly connected to the tab terminals "B" and "C" of the tab header connectors 108E-108H that receive switched electrical power when the switching element 400 is enabled. The tab terminals "A" of the tab header connectors 108E-108G, the tab terminals "D" of the tab header connectors 108G-108H, and the jumpers that interconnect them allow the dual run capacitor 442 connected to the tab header connector 108G to service two load devices—the compressor motor 434 and the fan motor 444.

In some embodiments, a jumper may be used connect the tab terminals "A" and "C" of the tab header connector 108A, and another jumper may be used connect the tab terminals "B" and "D" of the tab header connector 108A. The line conductors could be connected to the "A" and "B" tab terminals, allowing the line voltages to be passed through the tab header connector 108D via the "C" and "D" tab terminals and on to another electrical switching device (e.g., another contactor). Alternately, the line conductors could be connected to the "C" and "D" tab terminals, allowing the line voltages to be "twinned" via the "A" and "B" tab terminals.

In some embodiments, a jumper may be used connect the tab terminals "A" and "C" of the tab header connector 108B, and another jumper may be used connect the tab terminals "B" and "D" of the tab header connector 108B. This would allow two separate devices to be powered via the tab header connector 108B; one via the "A" and "B" tab terminals, and the other via the "C" and "D" tab terminals.

In other embodiments the fan motor 444 is not a load device, the tab header connector 108H and the jumpers between the tab header connectors 108G and 108H may be eliminated. A single capacitor may replace the dual run capacitor 442, connected between the "A" and "C" terminals of the tab header connector 108G.

In the embodiment of FIG. 4, some of the tab terminals of the tab header connectors 108A-108H are unused and may be eliminated. For example, the tab terminals "A" and "D" of the tab header connector 108A are unused and may be eliminated. Accordingly, the tab header connector 108A need only have two tab terminals. Similarly, the tab terminal "A" of the tab header connector 108H is unused and may be eliminated, so that header connector 108H would have three tab terminals. Further, the tab terminals "D" of the tab header connectors 108E and 108F are unused and may be eliminated, so that header connectors 108E and 108F have three tab terminals.

Figure 5:
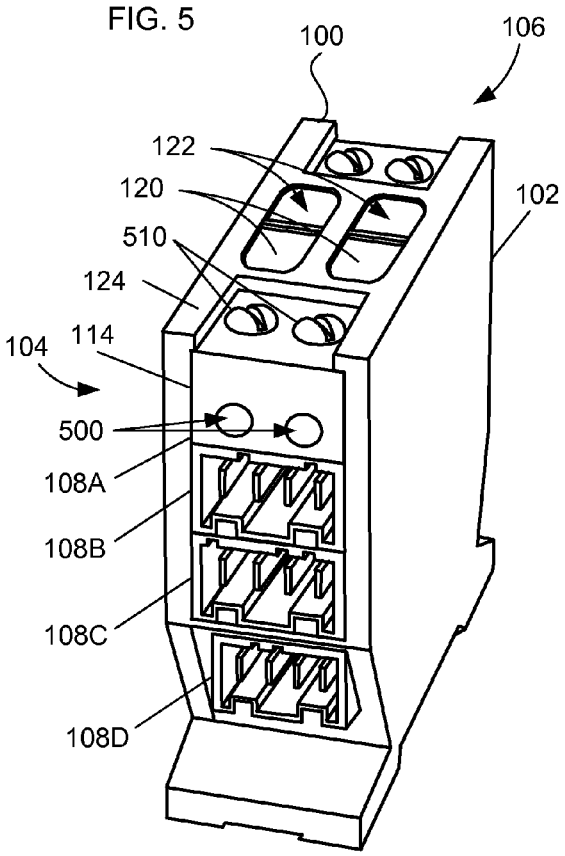
FIG. 5 is a perspective view of a line side of another embodiment of the electrical contactor of FIG. 1.
Figure 6:
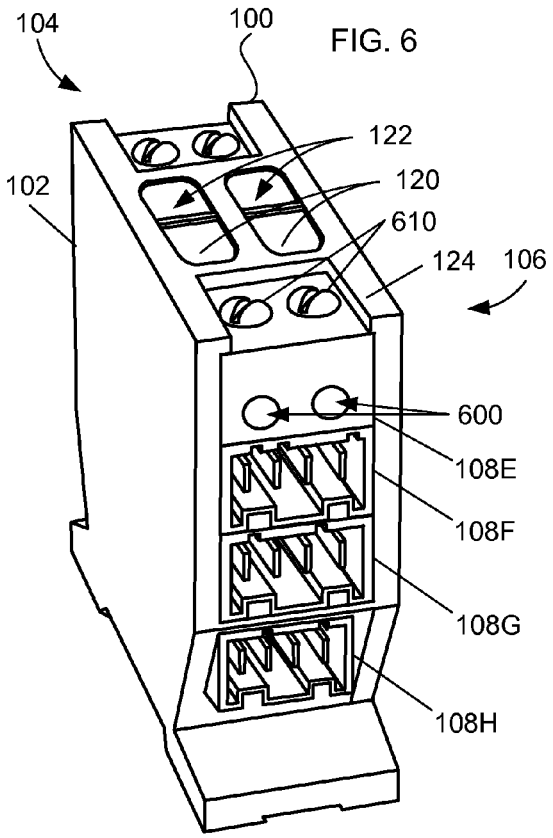
FIG. 6 is a perspective view of a load side of the contactor of FIG. 5.

FIGS. 5 and 6 are perspective views of another embodiment of the electrical contactor 100 where the connectors 108A and 108E each may have a pair of screw terminals for receiving wire conductors. FIG. 5 shows the line side 104 of the electrical contactor 100, and FIG. 6 shows the load side 106. As shown in FIG. 5, the connector 108A on the line side 104 may have a pair of screw terminals for receiving the line conductors. The connector 108A may have a pair of holes 500 in the outer face 114 for receiving the line conductors, and a pair of screws 510 for connecting to the line conductors. As shown in FIG. 6, the connector 108E on the load side 106 may have a pair of screw terminals for receiving wire leads connected to a compressor (e.g., two of the three wire leads of the compressor motor 434 of FIG. 4). The connector 108E may have a pair of holes 600 for receiving the wire leads, and a pair of screws 610 for connecting to the wire leads. It will be appreciated that other screw terminals and types of terminals could be used in the alternative to or in combination with each other and/or the tab terminals shown.

Figure 7:
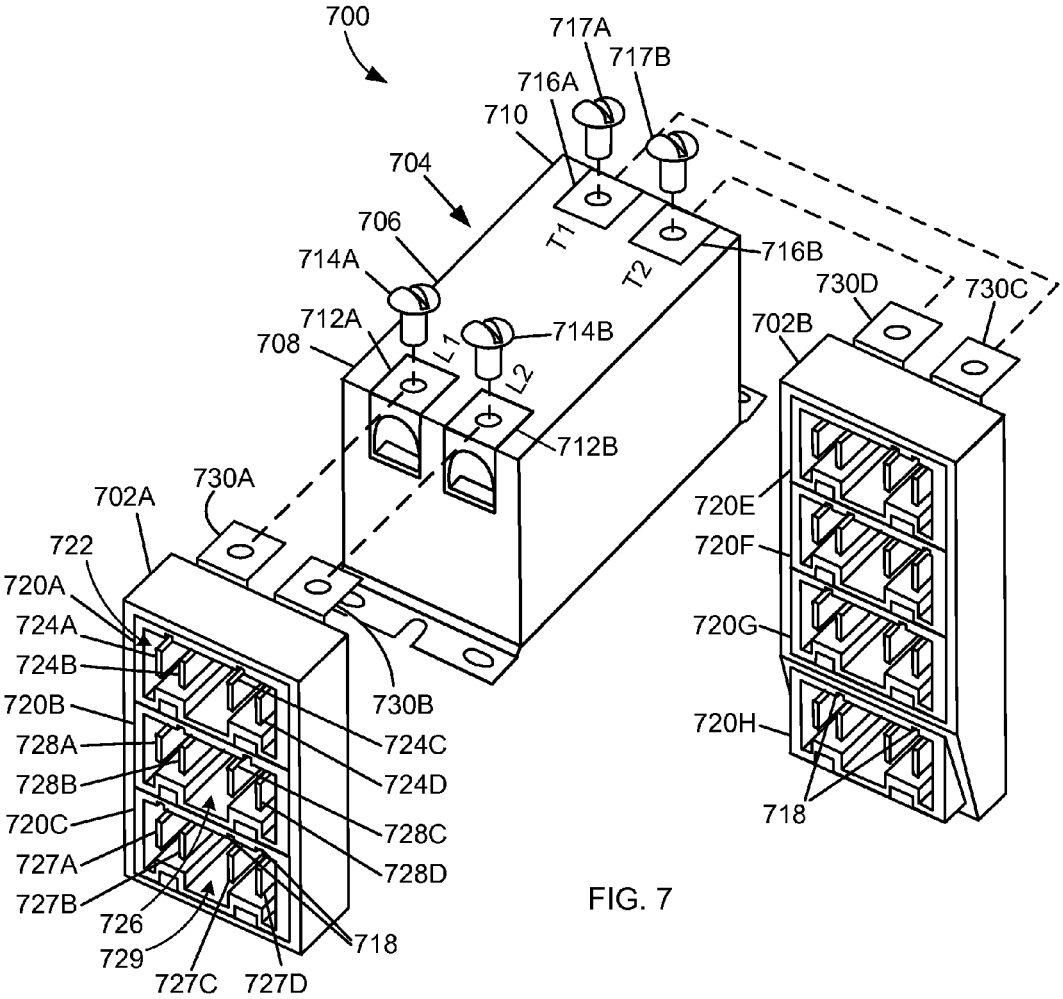
FIG. 7 is a perspective view of another embodiment of an electrical contactor.

FIG. 7 is a perspective view of another embodiment of an electrical contactor 700. In the embodiment of FIG. 7, the contactor 700 includes two connector assemblies 702A and 702B secured to a conventional electrical contactor 704. The connector assembly 702A is connected to two screw terminals 712A and 712B on a line side 708 of a housing 706 of the conventional contactor 704, and the connector assembly 702B is connected to two screw terminals 716A and 716B on a load side 710 of the housing 706. The conventional contactor 704 may be a commercially available electrical contactor, such as model HCC-1XQ01AB106 available from Hartland Controls of Rock Falls, Ill., or an equivalent contactor. In the embodiment of FIG. 7, each of the connector assemblies 702A and 702B includes multiple tab header connectors. Each of the multiple tab header connectors is a shrouded header connector with multiple, spaced apart tab terminals arranged in a cavity such that the tab terminals are recessed within the cavity.

In the embodiment of FIG. 7, the connector assembly 702A includes three tab header connectors 720A, 720B, and 720C arranged in a front side surface. The tab header connector 720A has four spaced apart tab terminals 724A-724D arranged in a cavity 722 such that the tab terminals 724A-724D are recessed within the cavity 722 with respect to an outer face of the tab header connector 720A. The tab header connector 720B has four spaced apart tab terminals 728A-728D arranged in a cavity 726 such that the tab terminals 728A-728D are recessed within the cavity 726 with respect to an outer face of the tab header connector 720B. The tab header connector 720C has four spaced apart tab terminals 727A-727D arranged in a cavity 729 such that the tab terminals 727A-272D are recessed within the cavity 729 with respect to an outer face of the tab header connector 720C.

In the embodiment of FIG. 7, the connector assembly 702A has two electrically conductive terminals 730A and 730B extending outwardly from a back side surface opposite the front side surface, and near a top of the connector assembly 702A. The connector assembly 702B has four tab header connectors 720E-720H arranged in a front side surface. The connector assembly 702B has two terminals 730C and 730D extending outwardly from a back side surface opposite the front side surface, and near a top of the connector assembly 702B. In the embodiment shown, the terminals 730A-730D are flat, rectangular tabs or tangs each having a hole for receiving a screw. In other embodiments, some or all of the terminals 730A-730D may be, for example, substantially cylindrical studs or prongs for insertion in wire-receiving openings of contactor terminals.

In the embodiment of FIG. 7, the three tab header connectors 720A-720C of the connector assembly 702A are similar to the respective tab header connectors 108A-108C of the contactor 100 of FIGS. 1-3, and the four tab header connectors 720E-720H of the connector assembly 702B are similar to the respective tab header connectors 108E-108H of the contactor 100 of FIGS. 1-3. Each of the tab header connectors 720A-720C and 720E-720H is mechanically coded to receive a corresponding plug connector. More specifically, each of the tab header connectors 720A-720C and 720E-720H has multiple keying and/or polarization slots 718 arranged in a manner similar to the multiple keying and/or polarization slots 318 shown in FIG. 3.

In the embodiment of FIG. 7, the screw terminals 712A and 712B on the line side 708 of the conventional electrical contactor 704 have removable screws 714A and 714B for securing terminals to the conventional contactor 704. The terminals 730A and 730B of the connector assembly 702A are arranged such that they align with the spaced apart screw terminals 712A and 712B. The screw terminals 716A and 716B on the load side 710 of the conventional electrical contactor 704 also have removable screws 717A and 717B for terminals to the conventional contactor 704. The terminals 730C and 730D of the connector assembly 702B are arranged such that they align with the spaced apart screw terminals 716A and 716B.

In assembly of the contactor 700, the connector assembly 702A is attached to the terminals 712A and 712B of the conventional contactor 704 by first removing the screws 714A and 714B of the screw terminals 712A and 712B. The terminals 730A and 730B of the connector assembly 702A are positioned over the screw terminals 712A and 712B. The screws 714A and 714B are passed through the holes in the respective terminals 730A and 730B, into the screw terminals 712A and 712B, and tightened, securing the terminals 730A and 730B to the screw terminals 712A and 712B. The connector assembly 702B is attached to the terminals 716A and 716B in a similar manner by first removing the screws 717A and 717B of the screw terminals 716A and 716B, positioning the terminals 730C and 730D of the connector assembly 702B over the screw terminals 716A and 716B, and installing and tightening the screws 717A and 717B.

The tab header connectors 720A-720C of the connector assembly 702A may be interconnected by internal jumpers in the manner described above with respect to tab header connectors 108A-108C, respectively, and shown in FIG. 4. The tab terminals 724B, 728B, and 727B of the respective tab header connectors 720A-720C may be electrically connected to one another and to the terminal 730A via jumpers, and the tab terminals 724C, 728C, and 727C of the respective tab header connectors 720A-720C may be electrically connected to one another and to the terminal 730B via jumpers. When an energized plug connector is inserted into the tab header connector 720A such that a first line voltage is applied to the tab terminal 724B and a second line voltage is applied to the tab terminal 724C, the first line voltage may be conducted to the screw terminal 712A of the conventional contactor 704, the tab terminal 728B of the tab header connector 720B, and the tab terminal 727B of the tab header connector 720C. The second line voltage may be conducted to the screw terminal 712B of the conventional contactor 704, the tab terminal 728C of the tab header connector 720B, and the tab terminal 727C of the tab header connector 720C. The first and second line voltages may be conveyed to one or more other devices via the tab header connectors 720B and 720C (e.g., as shown in FIG. 4 with respect to tab header connectors 108A-108C and described above).

With regard to the conventional contactor 704, when a first line voltage is applied to the screw terminal 712A via the connector assembly 702A, and a second line voltage is applied to the screw terminal 712B via the connector assembly 702A, and the conventional contactor 704 is enabled or energized, the first line voltage is applied to the screw terminal 716A and the second line voltage is applied to the screw terminal 716B (on the load side 710). By virtue of the electrical connections within the connector assembly 702B, the first line voltage is applied to one or more of the four tab terminals in each of the four tab header connectors 720E-720H, and the second line voltage is applied to at least one other of the four tab terminals in each of the four tab header connectors 720E-720H.

The tab header connectors 720E-720H of the connector assembly 702B may be interconnected by internal jumpers in the manner described above with respect to tab header connectors 108E-108H, respectively, and shown in FIG. 4. Second tab terminals of the of the tab header connectors 720E-720H may be electrically connected to one another and to the terminal 730C via jumpers, and third tab terminals of the of the tab header connectors 720E-720H may be electrically connected to one another and to the terminal 730D via jumpers. Like the tab header connectors 108E-108H, a subset of the tab terminals of the tab header connectors 720E-720H may be connected to one another via jumpers such that they are not electrically connected to the first line voltage or the second line voltage when the conventional contactor 704 is enabled or energized, allowing lead wires to load devices to be bundled (i.e., routed together in close proximity). It is noted that the current sensor 414 shown in FIG. 4, and the control unit 402 coupled to the current sensor 414, may be connected to the conventional contactor 704 in a conventional manner. In an embodiment, terminals 712B and 716B may be electrically connected by an internal jumper within the conventional contactor 704.

In other embodiments, the contactor 100 of FIGS. 1-6 may include circuitry for determining a condition of the dual run capacitor 442. The contactor 100 may also include circuitry for providing an indication of the above described fault condition (e.g., a lighted indicator or a mechanical flag). The contactor 100 may also include a terminal for providing a fault signal indicative of a fault condition. The contactor 100 may also include circuitry for receiving and storing information that defines when a fault condition occurs. The contactor 100 may also include circuitry for determining amounts of electric current drawn by load devices connected to one or more of the tab header connectors 108B-108C or 108E-108H during operation, and transmitting signals indicative of the amounts of electric current. The contactor 100 may also include circuitry for conveying a fault condition signal or signals indicative of the amounts of electric current via the line conductors, thus eliminating the need for additional communication terminals.

Numerous variations and modifications will become apparent to those skilled in the art once the above disclosure is fully appreciated. It is intended that the following claims be interpreted to embrace all such variations and modifications.

What is claimed is:

1. A heating, ventilating, and air conditioning electrical contactor, comprising:

a line-side electrical terminal is configured for connection to an electrical conductor carrying an electrical voltage;

a plurality of load-side connectors, each of the load-side connectors having a housing and a plurality of different electrical terminals arranged within a cavity of the housing, wherein said each of the load-side connectors is configured to receive a plug connector;

a switching element coupled between the line-side electrical terminal and the load-side connectors, and configured to electrically connect the line-side electrical terminal to at least one of the electrical terminals of at least one of the load-side connectors when enabled;

a control circuit coupled to the switching element and configured to receive a control signal and to enable the switching element in response to the control signal;

wherein each of a plurality of heating, ventilating, and air conditioning load devices comprises a corresponding plug connector that is connected to said each of the load-side connectors;

wherein said each of the load-side connectors is configured to receive the corresponding plug connector of said each of the load devices;

wherein said each of the load-side connectors is mechanically coded to receive the corresponding plug connector said each of the load devices;

wherein the electrical terminals of said each of the plurality of load-side connectors are arranged in the cavity such that the electrical terminals of said each of the plurality of load-side connectors are recessed within the cavity with respect to an outer face of said each of the load-side connectors;

wherein the switching element comprises a pair of electrical contacts and wherein the control circuit comprises a coil of wire; and wherein the electrical terminals of said each of the plurality of load-side connectors are coupled to one another via jumpers and are not electrically coupled to the line-side electrical terminal when the switching element is selected to not power said load-side connectors, thereby allowing to electrically power said each of the load devices that are connected to said each of the load-side connectors only when the switching element is selected to power said load-side connectors.

2. The electrical contactor as recited in claim 1, wherein said each of the load-side connectors corresponds to a different one of the plurality of load devices, and wherein the switching element is configured to electrically connect the line-side electrical terminal to at least one of the electrical terminals of said each of the load-side connectors when enabled.

3. The electrical contactor as recited in claim 1, wherein the electrical terminals of said each of the load-side connectors are tab terminals, and the load-side connectors are tab header connectors.

4. The electrical contactor as recited in claim 1, wherein the line-side electrical terminal is a tab terminal of a tab header connector.

5. The electrical contactor as recited in claim 1, wherein the line-side electrical terminal is a screw terminal or a box lug terminal.

6. A heating, ventilating, and air conditioning electrical contactor, comprising:

a pair of line-side electrical terminals, each of the line-side electrical terminals configured for connection to an electrical conductor carrying an electrical voltage;

a load-side terminal comprises a plurality of tab head connectors, wherein each tab head connector of the plurality of tab head connectors comprising a plurality of load-side electrical terminals;

a switching element coupled between the line-side electrical terminals and the load-side electrical terminals, and configured to electrically connect one of the line-side electrical terminals to one of the load-side electrical terminals when enabled;

a control circuit coupled to the switching element and configured to receive a control signal and to enable the switching element in response to the control signal;

a line-side connector having four electrical terminals, wherein two of the four electrical terminals are connected to the line-side electrical terminals, and wherein the other two of the four electrical terminals are electrically connected to one another;

wherein the four electrical terminals of the line-side connector electrically couple a crankcase heater, or a crankcase heater in series with a thermostat or switch, to receive electrical power via the line-side connector;

a plurality of heating, ventilating, and air conditioning load devices comprises a plurality of plug connectors, wherein each of the plurality of heating, ventilating, and air conditioning load devices comprises a corresponding plug connector of the plurality of plug connectors that is connected to said each of the plurality of tab head connectors; said each of the plurality of tab head connectors for mating with the corresponding plug connector of the plurality of plug connectors and wherein said each of the plug connectors is mechanically coded to only mate with a corresponding member of the plurality of tab head connectors;

wherein the line-side connector comprises a housing, and the four electrical terminals are arranged within a cavity of the housing; and wherein the four electrical terminals of the line-side connector are arranged in the cavity such that the four electrical terminals are recessed within the cavity with respect to an outer face of the line-side connector; and wherein the plurality of load-side electrical terminals of said each of the plurality of tab head connectors are coupled to one another via jumpers and are not electrically coupled to the four electrical terminals of the line-side connector when the switching element is selected to not power the load-side electrical terminals, thereby allowing to electrically power said each of the plurality of load devices that are connected to said each of the tab head connectors only when the switching element is selected to power.

7. The electrical contactor as recited in claim 6, wherein said the other two of the four electrical terminals of the line-side connector are electrically connected to one another by a jumper conductor.

8. The electrical contactor as recited in claim 6, wherein the line-side connector is configured to receive a plug connector.

9. The electrical contactor as recited in claim 6, wherein the four electrical terminals of the line-side connector are tab terminals, and the line-side connector is a tab header connector.

* * * * *